US010766591B2

(12) United States Patent
Hasl et al.

(10) Patent No.: US 10,766,591 B2
(45) Date of Patent: Sep. 8, 2020

(54) COOLING WATER DRAIN SYSTEM FOR A MARINE ENGINE

(71) Applicant: AB VOLVO PENTA, Gothenburg (SE)

(72) Inventors: Emil Hasl, Virginia Beach, VA (US); William M. Cahoon, Virginia Beach, VA (US); Justin Frohock, Virginia Beach, VA (US)

(73) Assignee: AB VOLVO PENTA, Gothenburg (SE)

( * ) Notice: Subject to any disclaimer, the term of this patent is extended or adjusted under 35 U.S.C. 154(b) by 0 days.

(21) Appl. No.: 16/333,045

(22) PCT Filed: Sep. 23, 2016

(86) PCT No.: PCT/US2016/053293

§ 371 (c)(1),
(2) Date: Mar. 13, 2019

(87) PCT Pub. No.: WO2018/056996

PCT Pub. Date: Mar. 29, 2018

(65) Prior Publication Data

US 2019/0202539 A1 Jul. 4, 2019

(51) Int. Cl.
*B63H 20/30* (2006.01)
*B63H 20/28* (2006.01)
(Continued)

(52) U.S. Cl.
CPC ..... *B63H 20/30* (2013.01); *B63H 20/28* (2013.01); *B63H 21/383* (2013.01); *F01P 11/20* (2013.01); *F01P 2050/06* (2013.01)

(58) Field of Classification Search
CPC ..... B63H 20/00; B63H 20/30; B63H 21/00; B63H 21/10; B63H 20/28; F01P 11/00;
(Continued)

(56) References Cited

U.S. PATENT DOCUMENTS 5,423,703 A 6/1995 Lorenzen
6,050,867 A * 4/2000 Shields ..... F01P 11/0276 440/880

(Continued)

OTHER PUBLICATIONS

International Search Report dated Dec. 7, 2016 in International Application No. PCT/US2016/053293.

(Continued)

*Primary Examiner* — Lars A Olson
(74) *Attorney, Agent, or Firm* — Venable LLP; Jeffri A. Kaminski

(57) ABSTRACT

A drain system for a marine engine cooling system, includes an engine having one of a closed coolant circuit or an open cooling circuit, a raw water passageway having a raw water intake for drawing raw water into the raw water passageway, including a hose arranged to have a vertically high point and a vertically low point, a drain valve connected to the raw water passageway at the in hose vertically low point, a vent line connected to the raw water passageway at the hose vertically high point and a control handle located remote from the hose vertically high point and the hose vertically low point, the control handle having a vent valve connected to the vent line, the control handle being connected to the drain valve by a cable, wherein movement of the control handle selectively simultaneously opens and closes the drain valve and the vent valve.

6 Claims, 5 Drawing Sheets

(51) Int. Cl.
*F01P 11/20* (2006.01)
*B63H 21/38* (2006.01)

(58) Field of Classification Search
CPC ... F01P 11/02; F01P 11/06; F01P 11/20; F01P 3/20
USPC ..... 440/88 C, 88 N, 88 R
See application file for complete search history.

(56) References Cited

U.S. PATENT DOCUMENTS

| | | | | |
|---|---|---|---|---|
| 6,089,934 | A | 7/2000 | Biggs et al. | |
| 6,390,870 | B1 * | 5/2002 | Hughes | F01P 3/205 440/88 N |
| 6,571,753 | B1 | 6/2003 | Jaeger | |
| 7,438,613 | B2 * | 10/2008 | Hubbs | F01P 3/205 440/880 |
| 7,585,196 | B1 | 9/2009 | Jaeger | |
| 2009/0029609 | A1 | 1/2009 | Breece et al. | |

OTHER PUBLICATIONS

Written Opinion dated Dec. 7, 2016 in International Application No. PCT/US2016/053293.
Extended European Search Report dated Mar. 31, 2020 in corresponding EP Application No. 16916962.0, 7 pages.

* cited by examiner

COOLING WATER DRAIN SYSTEM FOR A MARINE ENGINE

FIELD OF THE INVENTION

The invention relates to a cooling water system for marine engines, and more particularly, to a system for draining cooling water from a marine engine cooling system.

BACKGROUND AND SUMMARY

Marine vessels often use "raw" water, for example, untreated sea water or lake water, for engine cooling. An open loop cooling system uses raw water as the sole coolant, drawing raw water into the system through an inlet formed on a drive unit or on the hull, circulating the raw water through the engine coolant passages, and discharging the raw water through the engine exhaust. A second type of system includes a closed loop part that circulates a coolant fluid (typically, a water-propylene glycol mixture) through engine coolant passages and through a water-to-water heat exchanger. A second part of the system draws raw water from outside the hull and directs it through the heat exchanger to remove heat from the coolant fluid. The raw water is then discharged through the engine exhaust system.

Both types of cooling system require occasional draining of the raw water from the cooling system. For example, raw water should be drained from the system when the ambient temperature is expected to fall below freezing to prevent damage to the engine (in the open loop system) or other coolant system components. Raw water is also drained so that the cooling system can be flushed with fresh water to remove salt residue, silt, and other undesirable substances.

Stern drives have engines mounted inside the hull. Draining cooling water from these arrangements includes opening a drain cock, removing a plug, or detaching a hose located at a low point of the cooling circuit and allowing the water to drain into the bilge under the force of gravity. Because it is located at a low point, the drain cock, plug, or hose is often difficult to reach. To solve this problem, U.S. Pat. No. 6,390,870 to Hughes, et al. proposes an open loop cooling system having a manifold located at a low point of the engine cooling system to which the various cooling hoses are connected. The manifold includes a drain tube. An elongated rod is mounted for movement that opens and closes the drain tube, the rod having a plug end that is removably inserted in the drain tube and a handle at an end accessible at a location above the manifold.

To drain the cooling system while the vessel is in the water, that is, when the raw water intake is submerged in the water, it is necessary to prevent siphoning of new raw water into the system as the draining raw water flows from the drain. This may be done by opening a vent in the water line to allow air in the line. Examples of vents in the art include passive vents, for example, float valve controlled vents and manually operated vents.

The invention provides an apparatus for draining a marine engine cooling system, including a raw water passageway having a raw water intake for drawing raw water into the raw water passageway, and including a conduit arranged to have a vertically high point and a vertically low point, a drain valve connected to the raw water passageway at the conduit vertically low point, a vent line connected to the raw water passageway at the conduit vertically high point and, a control handle located remote from the conduit vertically high point and the conduit vertically low point, the control handle being operatively connected to a vent valve connected to the vent line, wherein actuating movement of the control handle selectively opens and closes the vent valve.

According to the invention, the control handle is connected to the drain valve by a cable, and the actuating movement of the control handle that opens and closes the vent valve simultaneously opens and closes the drain valve.

According to an embodiment of the invention, the drain valve includes a hollow, cylindrical body having a drain inlet and a drain outlet, with a spool disposed in the hollow, cylindrical body and connected to the cable, the spool having a first position preventing flow between the drain inlet and the drain outlet and a second position connecting the drain inlet and the drain outlet.

According to another aspect of the invention, the vent valve is integrated in the control handle. The control handle of this embodiment comprises a tubular body having a vent port to which the vent line is connected and having an air relief opening, and comprising a valve member movably disposed in the tubular body having a closed position blocking flow between the vent port and the air relief opening and having an open position allowing flow between the vent port and the air relief opening.

Alternatively, the vent valve is located remote of the control handle and the control handle is connected to the vent valve by a cable.

BRIEF DESCRIPTION OF THE DRAWINGS

The invention will be better understood by reference to the following detailed description read in conjunction with the figures, in which.

DETAILED DESCRIPTION

Figure 1:
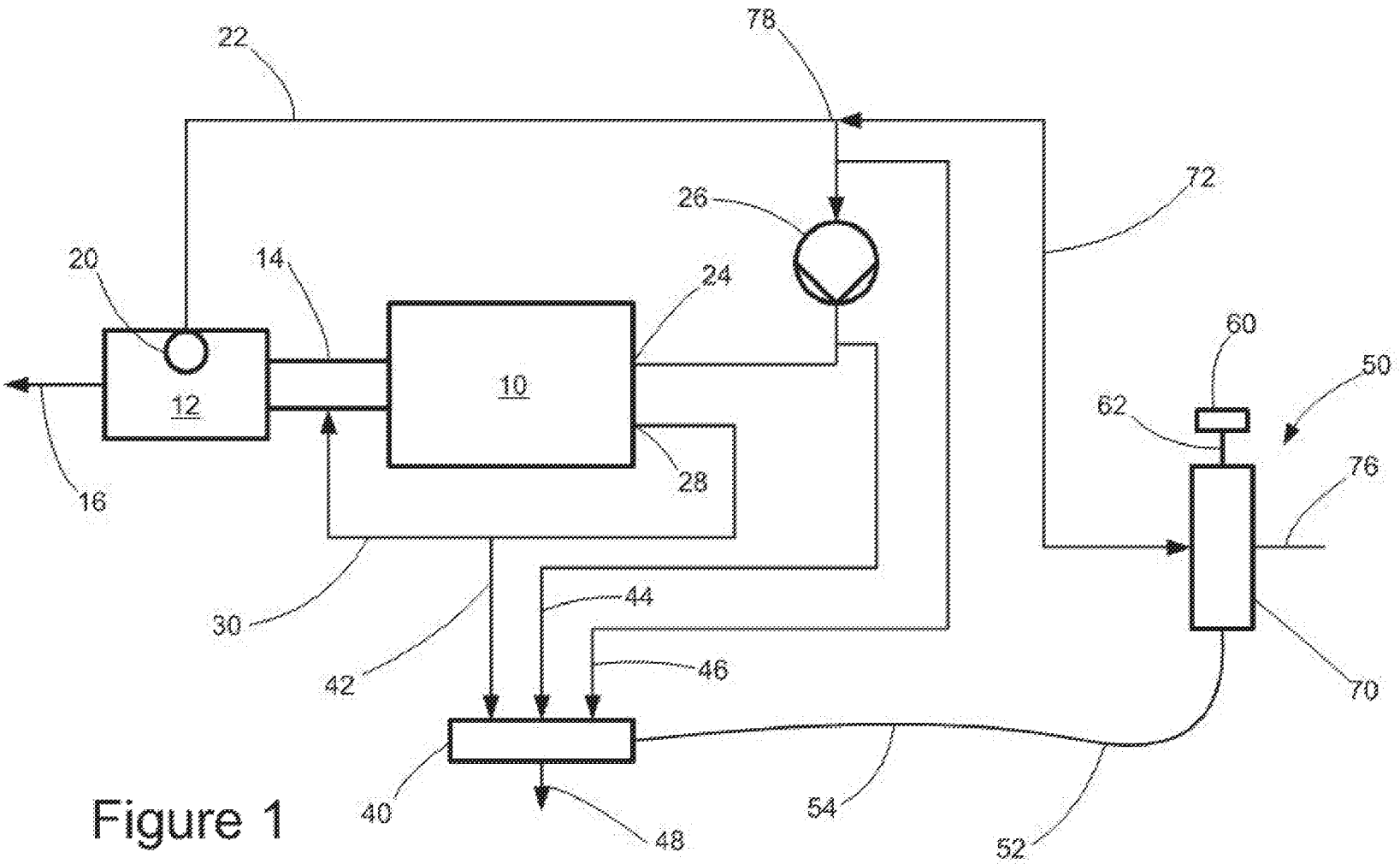
FIG. 1 is a schematic drawing of an open loop cooling system for a marine engine according to an embodiment of the invention.

FIG. 1 is a schematic drawing of an open loop cooling system for a marine engine that includes a water drain system according to an embodiment of the invention. FIG. 1 illustrates a stern drive arrangement including an engine 10, which is disposed in the vessel hull (not illustrated) and a drive unit 12 mounted on the stern (also not illustrated). The engine exhaust is carried by one or more exhaust conduits 14 to the drive unit 12, which includes an internal conduit which directs the exhaust through the propeller hub 16 and into the wash behind the vessel.

The open loop cooling system includes a raw water intake port 20 on the drive unit 12. Alternatively, a raw water intake may be provided on the vessel hull. Raw water is carried by an intake conduit 22 to the engine inlet port 24. A pump 26 is disposed on the intake conduit 22 to circulate the water. The raw water circulates through cooling passages (not illustrated) formed in the engine 10 and exits through the outlet port 28. The used raw water is carried by an outtake conduit 30 to the engine exhaust conduits 14. The exhaust conduits 14 may be jacketed and the raw water may be first introduced into the jacket or jackets to cool the exhaust conduits, as well as the exhaust gas, before being directed into the engine exhaust flow.

A drain valve 40 is connected to the cooling system at a vertically low point of the system, that is, a location where gravity will cause the water to flow. The drain valve 40 may be connected to one or more of the cooling system conduits. As illustrated, the drain valve 40 is connected by a first drain conduit 42 to the outtake conduit 30, by a second drain conduit 44 to the intake conduit 22 on the inlet side of the pump 26, and by a third drain conduit 46 to the intake conduit 22 on an outlet side of the pump. The drain valve 40 includes at least one drain outlet 48. FIG. 1 (and FIG. 2 which shows an alternative arrangement) is a schematic drawing; in a physical layout, the cooling system conduits 22, 24 and pump 26 may be arranged at physical low points to facilitate gravity-induced drainage.

The drain valve 40 is closed during normal use of the engine, that is, when the cooling system is operated, and will be opened when desired to drain the cooling system. When the drain valve 40 is closed, there is no flow through the drain valve or the drain conduits 42, 44, 46. An exemplary drain valve 40 is described in connection with FIG. 3.

Still referring to FIG. 1, the drain valve 40 is operated by a control handle 50 located remote from the drain valve and connected to the drain valve by a cable 52. The cable is preferably a wire rope cable capable of receiving and transmitting push and pull forces. Sliding movement of the handle 50 is transmitted by the cable to the drain valve 40 to selectively open or close the valve. The cable 52 is carried by a sheath 54 to constrain movement of the cable to the sliding movement. The control handle 50 has a handle 60 connected by a shaft 64 to the cable 52 to impart the sliding movement. Because the control handle 50 is connected by a cable to the drain valve 40, the cable may be routed as convenient and the control handle may be conveniently located relative to the engine 10 for ready access.

The control handle 50 includes an anti-siphon vent valve 70, described in greater detail in connection with FIG. 4. The vent valve 70 is opened and closed with the same action of the control handle 50 that opens and closes the drain valve 40, so that both the drain valve and vent valve are open at the same time and both are closed at the same time. As shown in FIG. 1, the vent valve 70 is connected by a vent line 72 to the raw water intake conduit 22 at a vertically high point 78 of the intake conduit, that is, a point which is always above the waterline of the vessel. The intake conduit 22 may be routed to provide the high point 78, which may be, but is not necessarily, the physically highest point of the intake conduit 22. The vent valve 70 includes an air relief opening 76. In the vent valve open position, the vent valve air relief opening 76 is in communication with the raw water intake conduit 22 by way of the vent line 72, allowing air to flow into the vent line and intake conduit 22 and preventing a siphon effect in the water drain circuit.

Figure 2:
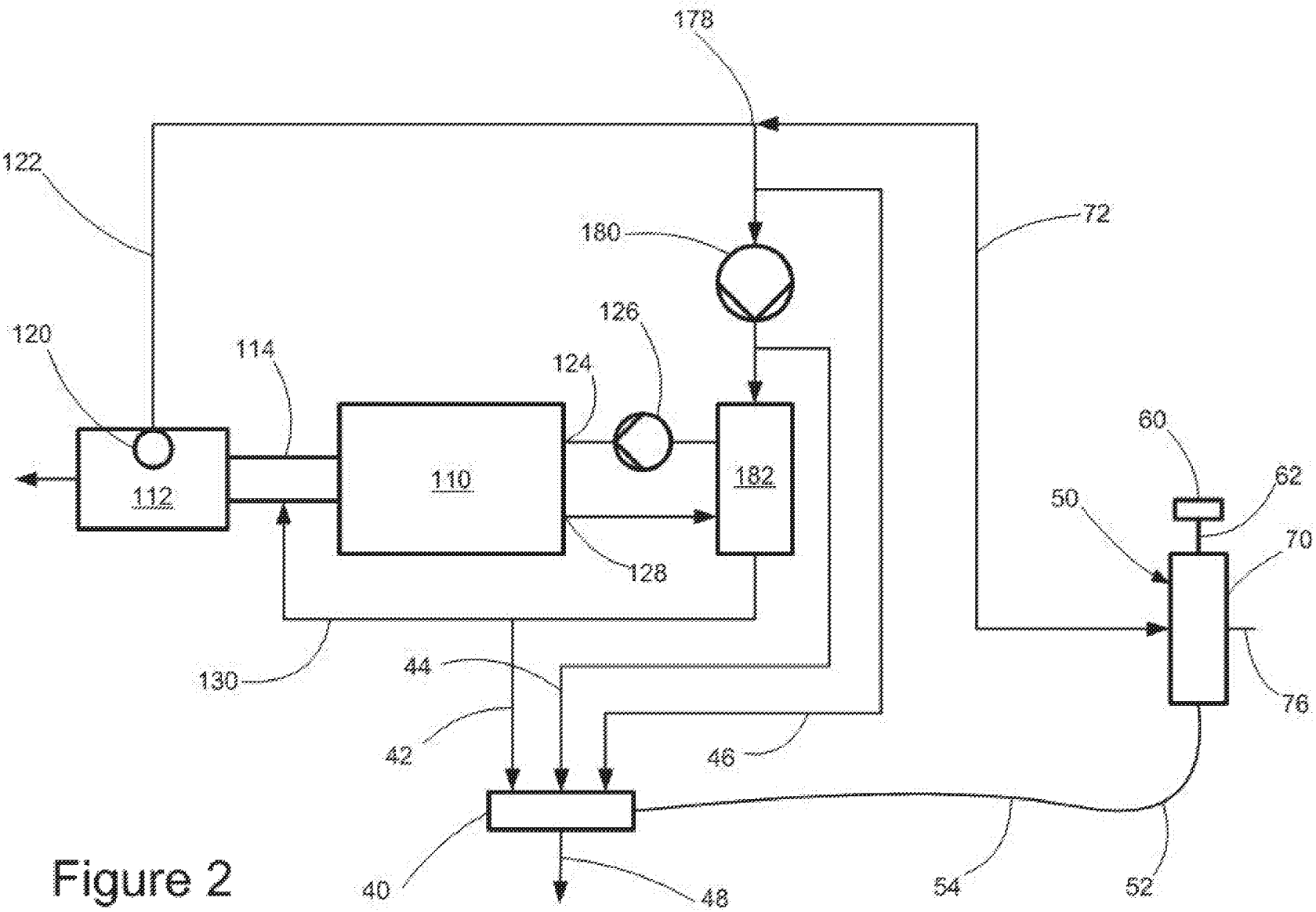
FIG. 2 is a schematic drawing of a closed loop cooling system for a marine engine having an open loop heat exchanger according to another embodiment of the invention.

FIG. 2 shows an alternative arrangement including a closed loop engine cooling system with a raw water heat exchanger 182. In the arrangement of FIG. 2, the engine 110 has a closed loop cooling system including a pump 126 that circulates a coolant (typically a water-propylene glycol mixture) into a cooling inlet 124, through the engine cooling passages (not illustrated), out a cooling outlet 128, through a heat exchanger 182, and back to the cooling inlet. The arrangement flows raw water through the heat exchanger 182 to cool the engine coolant. Raw water is drawn into the system through an intake 120 formed on the drive 112 (or alternatively, the vessel hull) and is carried by an intake conduit 122 to the heat exchanger 182. A pump 180 pulls the raw water through the intake conduit 122 and directs the raw water through the heat exchanger 182 and through an outtake conduit 130 to the engine exhaust 114. After use by the system, raw water is ejected through the engine exhaust 114 out of the propeller hub 116.

The raw water system includes a drain valve 40 and control handle 50 according to the invention and as described in connection with FIG. 1. The drain valve 40 is connected to the raw water cooling system at a vertically low point of the system, that is, a location where gravity will cause the water to flow. The drain valve 40 may be connected to one or more of the cooling system conduits. As illustrated, the drain valve 40 is connected by a first drain conduit 42 to the outtake conduit 130, by a second drain conduit 44 to the intake conduit 122 on the inlet side of the pump 180, and by a third drain conduit 46 to the intake conduit 122 on an outlet side of the pump. The drain valve 40 includes at least one drain outlet 48.

The drain valve 40 is operated by a control handle 50 located remote from the drain valve and connected to the drain valve by a cable 52, preferably, a wire rope cable capable of receiving and transmitting push and pull forces. Sliding movement of the handle 50 is transmitted by the cable to the drain valve 40 to selectively open or close the valve. The cable 52 is carried by a sheath 54 to constrain movement of the cable to the sliding movement. The control handle 50 has a handle 60 connected by a shaft 64 to the cable 52 to impart the sliding movement. Because the control handle 50 is connected by a cable to the drain valve 40, the cable may be routed as convenient and the control handle may be conveniently located relative to the engine 110 for ready access.

The control handle 50 includes an anti-siphon vent valve 70, described in greater detail in connection with FIG. 4. The vent valve 70 is opened and closed with the same action of the control handle 50 that opens and closes the drain valve 40, so that, both the drain valve and vent valve are open at the same time and both are closed at the same time. The vent valve 70 is connected by a vent line 72 to the raw water intake conduit 22 at a vertically high point 78 of the intake conduit, that is, a point which is always above the vessel waterline.

The intake conduit 22 may be routed to provide the high point 78. The vent valve 70 includes an air relief opening 76. In the open position, the vent valve relief opening 76 is in communication with the raw water intake 22 by way of the vent line 72, allowing air to flow and preventing a siphon effect in the water drain circuit.

Figure 3:
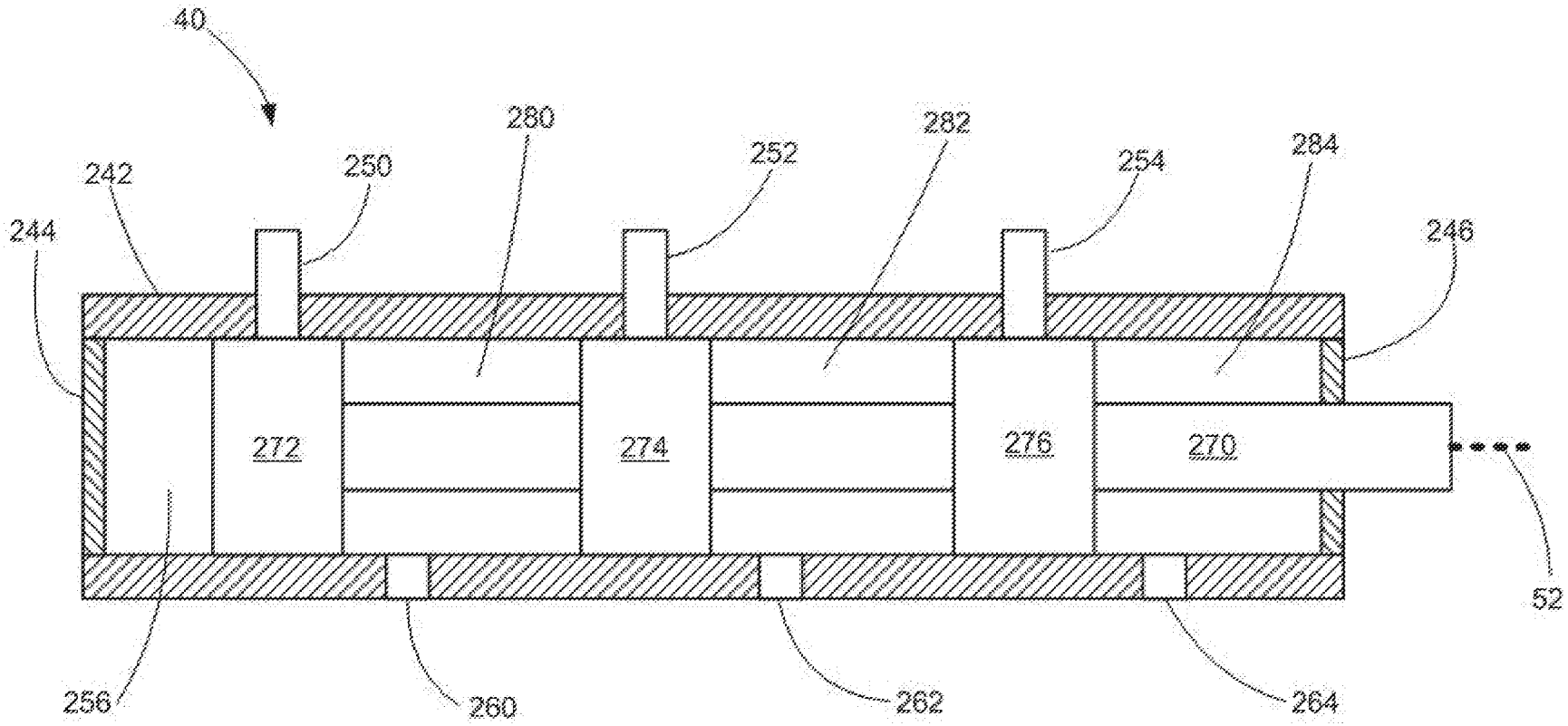
FIG. 3 is a drawing of a water drain valve according to the invention.

FIG. 3 is a schematic drawing of an exemplary embodiment of a drain valve 40 in accordance with the invention. The drain valve 40 is a sliding spool type valve and includes a hollow cylindrical body 242 that is closed at both ends by end walls 244, 246. The drain valve body 242 includes inlet openings 250, 252, 254 for connecting the drain conduits 42, 44, 46 (see, FIGS. 1 and 2) to the interior 256 of the drain valve body, and include exit openings 260, 262, 264. A sliding spool 270 is disposed in the interior 256 of the drain valve 40 and includes three lands 272, 274, 276 that control drain water flow through the inlet openings 250, 252, 254 and define between them grooves or chambers that allow water flow. The lands 272, 274, 276 are shown in FIG. 3 in a closed position, and may include O-rings or other appropriate devices to ensure sealing against the drain valve body 242. The lands 272 and 274 define between them a chamber 280, lands 274 and 276 define a chamber 282, and the land 276 and the end wall 246 define a chamber 284. The spool 270 is coupled to the control handle cable 52 in a convenient manner so that the spool may be caused to slide by movement of the control handle 50 transmitted by the cable. Sliding movement of the spool 270 in the valve body 242 in the direction to the left in FIG. 3 causes chamber 280 to be open to inlet opening 250 and exit opening 260, chamber 282 to be open to inlet opening 252 and exit opening 262, and chamber 284 to be open to inlet opening 254 and exit opening 264, which allows water to drain from the drain lines 42, 44, and 46 through the drain valve 40.

Figure 4:
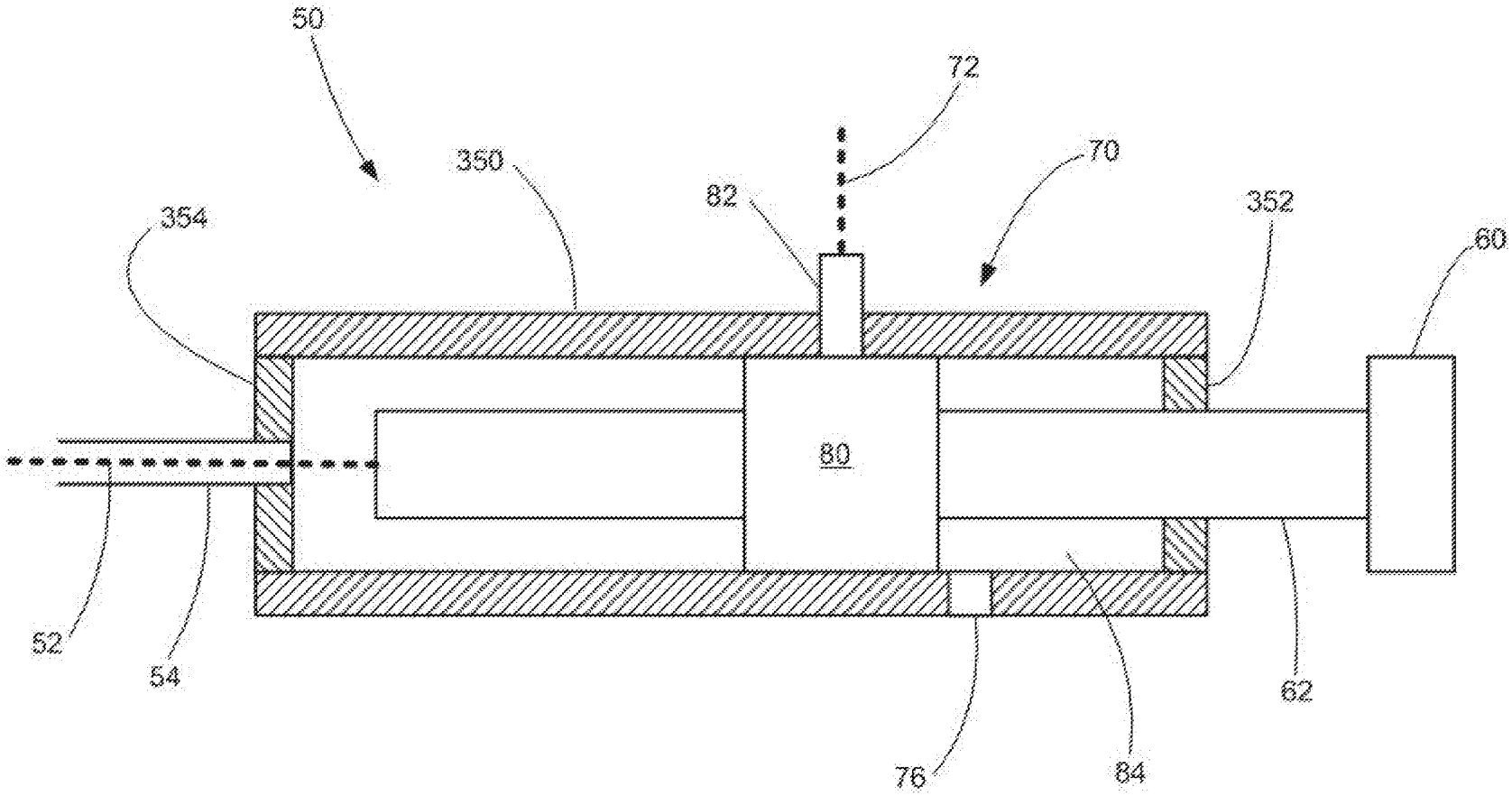
FIG. 4 is a drawing of a control handle having an integrated vent valve according to the invention; and, FIG. 5 is a schematic drawing of an alternative embodiment of the control handle.

FIG. 4 is a schematic drawing of an exemplary embodiment of a control handle 50 in accordance with the invention. The control handle 50 includes a handle body 350 which is adapted to be mounted on or near the engine 10 in a location that is readily accessible to a user. A handle 60 for manually operating the control handle is carried on a shaft 62. The shaft 62 is supported by end walls 352, 354 of the handle body 350 for sliding movement actuated manually by the handle 60. The end of the shaft 62 opposite the handle 60 is coupled to the cable 52 so that sliding movement of the handle 60 and shaft 62 is imparted to the cable 52 and transmitted to the drain valve 40 as described above.

The control handle 50 illustrated in FIG. 4 includes a vent valve 70 integrated in the handle body 350 and actuated by the handle 60 and shaft 62. The vent valve 70 includes a spool 80 disposed in the handle body 350 and coupled to the shaft 62 for sliding movement in the handle body 350. The spool 80 and the end wall 352 define between them a chamber 84. The spool 80 has a closed position that blocks a vent port 82, which may be formed as a nipple, that connects to the vent line 72. The spool 80 has an open position, when moved relative to the handle body 350 to the left in FIG. 4, that connects the vent port 82 and the air relief opening 76 to the chamber 84, which allows the free flow of air through the chamber 84 and to the vent line 72.

The control handle 50 shown and described is operated manually by pushing or pulling the handle 60. However, those skilled in the art will understand that a motor, for example, a solenoid, may be used in place of the handle 60 and operated by a switch at the vessel helm.

Figure 5:
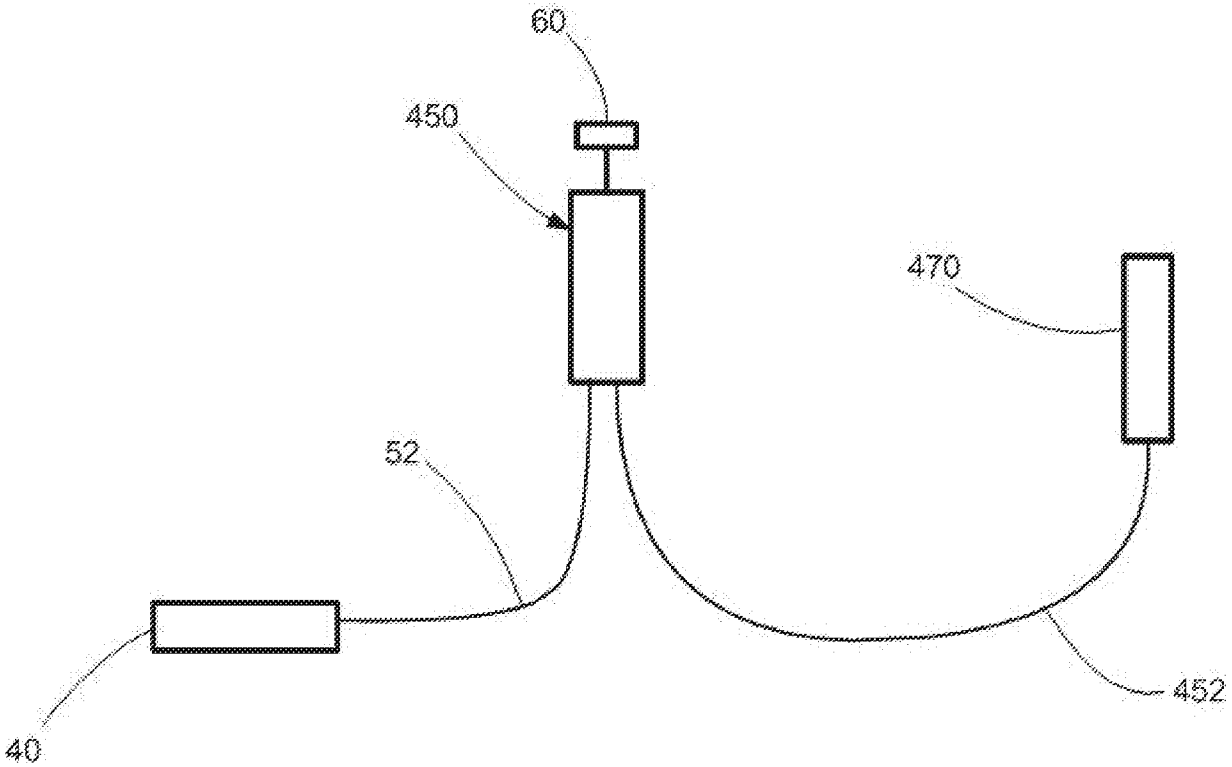

FIG. 5 is a schematic drawing of an alternative embodiment of the control handle 450.

According to this embodiment, a vent valve 450 is a separate component (i.e., not integrated in the control handle as shown in FIG. 4) and is located remote from the control handle 450. Both the drain valve 40 and the vent valve 450 are actuated by cables 52, 452, respectively, connected to the control handle 450. The vent valve 450 of this embodiment may be located at any convenient place, for example, adjacent to the high points of the intake conduits (see, FIG. 1 and FIG. 2).

The foregoing description is meant to be illustrative and not limited to the literal terms described; other variations or substitutions may be made as will occur to those skilled in the art. For example, the drain valve and vent valve have been shown and described as sliding spool valves, but other valve arrangements are possible, including rotary spool valves, gate valves, and other valves that may be actuated by a linear movement of a cable.

We claim:

1. A marine engine cooling system, comprising:
   - a raw water passageway having a raw water intake for drawing raw water into the raw water passageway, and including a conduit arranged to have an upper point and a lower point;
   - a drain valve connected to the raw water passageway at the conduit lower point;
   - a vent line connected to the raw water passageway at the conduit higher point; and,
   - a control handle located remote from the conduit higher point and the conduit lower point, the control handle being operatively connected to a vent valve connected to the vent line, wherein actuating movement of the control handle selectively opens and closes the vent valve.

2. The marine engine cooling system of claim 1, wherein the control handle is connected to the drain valve by a cable, wherein said actuating movement of the control handle selectively opens and closes the drain valve.

3. The marine engine cooling system of claim 2, wherein said movement is along an axial direction of the handle.

4. The marine engine cooling system of claim 2, wherein the drain valve comprises a hollow, cylindrical body having a drain inlet and a drain outlet, and comprising a spool disposed in the hollow, cylindrical body and connected to the cable, the spool having a first position preventing flow between the drain inlet and the drain outlet and a second position connecting the drain inlet and the drain outlet.

5. The marine engine cooling system of claim 1, wherein the control handle comprises a tubular body having a vent port to which the vent line is connected and having an air relief opening, and comprising a valve member movably disposed in the tubular body having a closed position blocking flow between the vent port and the air relief opening and having an open position allowing flow between the vent port and the air relief opening.

6. The marine engine cooling system of claim 1, wherein the control handle is connected to the vent valve by a cable.

* * * * *